US012753916B2

(12) United States Patent
Bhayaraju et al.

(10) Patent No.: US 12,753,916 B2
(45) Date of Patent: Oct. 6, 2026

(54) REFRACTORY BLOCK FOR LOW NOX BURNERS WITH INTERNAL FLUE GAS RECIRCULATION

(71) Applicant: Honeywell International Inc., Charlotte, NC (US)

(72) Inventors: Umesh Chandra Bhayaraju, Carmel, IN (US); Curtis Lynn Taylor, Paradise Valley, AZ (US); Bradley Dean Patterson, Dunkirk, IN (US); Ross Halstead, Mooreland, IN (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 958 days.

(21) Appl. No.: 17/954,525

(22) Filed: Sep. 28, 2022

(65) Prior Publication Data

US 2024/0102646 A1 Mar. 28, 2024

(51) Int. Cl.
*F23C 9/00* (2006.01)

(52) U.S. Cl.
CPC ..... *F23C 9/006* (2013.01); *F23C 2202/10* (2013.01)

(58) Field of Classification Search
CPC .. F23C 9/006; F23C 2202/10; F23C 2202/30; F23C 9/06; F23M 2900/05021
USPC ..... 431/116
See application file for complete search history.

(56) References Cited

U.S. PATENT DOCUMENTS 2,596,507 A * 5/1952 Perry ..... C01C 3/0237 423/375
5,238,395 A 8/1993 Schwartz et al.
5,413,477 A 5/1995 Moreland
8,337,197 B2 12/2012 Poe et al.
10,451,271 B2 10/2019 Taylor et al.
10,533,741 B2 1/2020 Taylor et al.
2007/0292811 A1* 12/2007 Poe ..... F23M 5/025 431/278
2021/0215337 A1* 7/2021 Coscia ..... F23G 7/085
(Continued)

FOREIGN PATENT DOCUMENTS

CN 201425301 Y 3/2010
CN 206219426 U * 6/2017
CN 113007707 A 6/2021
(Continued)

OTHER PUBLICATIONS

"LO-NOx burner", wikipedia, retrieved from "https://en.wikipedia.org/w/index.php?title=LO-NOx_burner&oldid=1058075240"; page last edited on Dec. 1, 2021.
(Continued)

*Primary Examiner* — Allen R. B. Schult
*Assistant Examiner* — William C Weinert
(74) *Attorney, Agent, or Firm* — Ingrassia Fisher & Lorenz

(57) ABSTRACT

A refractory apparatus may include a refractory block comprising a heat shield. The refractory block can include a group of flue gas ports that acts as a gateway for flue gas produced due to combustion downstream of a burner. A suction created in the burner drives the flue gas into the burner through the flue gas ports. A group of staged risers can be housed within the refractory block. The staged risers are protected in staged fuel riser housings in the refractory block. A discharge cone is located in the refractory block for flame stabilization in the burner.

6 Claims, 6 Drawing Sheets

(56) References Cited

U.S. PATENT DOCUMENTS

| | | | |
|---|---|---|---|
| 2021/0254860 | A1 | 8/2021 | O'Donnell et al. |
| 2022/0163197 | A1 | 5/2022 | Taylor et al. |

FOREIGN PATENT DOCUMENTS

| | | | | | |
|---|---|---|---|---|---|
| JP | 2012127619 | A | * | 7/2012 | |
| WO | WO-03081135 | A1 | * | 10/2003 | ..... F23M 11/042 |

OTHER PUBLICATIONS

"Ultra Low NOx Burner: Everything You Should Know", Jun. 12, 2019; Ruichang, https://burnertec.com/ultra-low-nox-burner-everything-you-should know/.

* cited by examiner

REFRACTORY BLOCK FOR LOW NOX BURNERS WITH INTERNAL FLUE GAS RECIRCULATION

TECHNICAL FIELD

Embodiments are generally related to low NOx burners and in particular to ultra-low NOx industrial burners used with process heaters and industrial boilers. Embodiments also relate to a refractory and refractory block used in NOx burners.

BACKGROUND $NO_x$ oxides of nitrogen in the form of nitrogen oxide (i.e., NO) and nitrogen dioxide ($NO_2$) (oxides of nitrogen can generally be referred to as: NOx) are generated by the burning of fossil fuels. Along with NOx from vehicles, NOx from fossil fuel fired industrial and commercial heating equipment (e.g., furnaces, ovens, etc.) is a major contributor to poor air quality and smog. $NO_x$ emissions from burning fossil fuels are a major contributor to air quality and depletion of ozone layer.

In industrial burners, the air from a blower or process air is mixed with fuel (natural gas or propane or any type of gaseous fuel or liquid fuel) to produce heat. When fuel is burnt, NOx is formed due to the presence of nitrogen and oxygen in air.

Present-day industrial burners can achieve, for example, <30 ppm NOx with EFGR at 15% excess air in the exhaust. Numerous studies have shown that adding flue gas to the air can reduce NOx significantly. When flue gas is added to the air, the overall concentrations of Nitrogen and Oxygen can be reduced in the air-flue gas mixture (as flue gas contains predominantly $CO_2$ and $H_2O$). Furthermore, due to the high heat capacities of $CO_2$ and $H_2O$, the flame temperature reduces, thereby leading to a lower flame temperature. This lower flame temperature can reduce NOx.

External flue gas recirculation (EFGR) requires that the exhaust gas should be piped back from the exhaust stack to the combustion air intake where it can enter the blower to be mixed with the combustion air. This method requires additional piping and devices around the burner and boiler (or another fired chamber). This also requires an enlargement or up-sizing of the combustion air fan to handle the increased volume of the added flue gas.

BRIEF SUMMARY

The following summary is provided to facilitate an understanding of some of the features of the disclosed embodiments and is not intended to be a full description. A full appreciation of the various aspects of the embodiments disclosed herein can be gained by taking the specification, claims, drawings, and abstract as a whole.

It is, therefore, one aspect of the disclosed embodiments to provide for a refractory apparatus for a burner including a refractory block that functions as a heat shield for the burner.

It is another aspect of the disclosed embodiments to provide for an improved burner.

It is a further aspect of the disclosed embodiments to provide for an improved NOx burner.

It is an additional aspect of the disclosed embodiments to provide for an ultra-low NOx (ULE) burner that uses Internal Flue Gas Recirculation (IFGR).

The aforementioned aspects and other objectives can now be achieved as described herein. In an embodiment, a refractory apparatus may include a refractory block comprising a heat shield, wherein the refractory block includes a plurality of flue gas ports that acts as a gateway for flue gas produced due to combustion downstream of a burner. The suction created in the burner drives the flue gas into the burner through the plurality of flue gas ports. The refractory apparatus can further include a plurality of staged risers housed within the refractory block, wherein the plurality of staged risers is protected in staged fuel riser housings in the refractory block. The refractory apparatus can also include a discharge cone located in the refractory block for flame stabilization in the burner.

In an embodiment of the refractory apparatus, the plurality of flue gas ports can comprise angles that vary from 0 to 90 degrees.

In an embodiment of the refractory apparatus, the refractory block can comprise a refractory material configured on aluminum and silicon oxides with a temperature rating greater than, for example, 2600 F.

In an embodiment of the refractory apparatus, each flue gas port among the plurality of flue gas ports can include or be configured with a slot having a slot area selected to obtain flue gas up to, for example, 20% of combustion air.

In an embodiment of the refractory apparatus, a slot can be included in the refractory apparatus having a shape that is circular or rectangular with curved edges.

In an embodiment of the refractory apparatus, a flange can be connected to the refractory block.

In an embodiment of the refractory apparatus, each staged riser among the plurality of staged rises can comprise stainless steel.

In an embodiment of the refractory apparatus, the plurality of flue gas ports can include a number of flue gas ports ranging from four flue gas ports to twelve flue gas ports.

In another embodiment, a refractory apparatus can include a refractory block comprising a heat shield, wherein the refractory block includes a plurality of flue gas ports that acts as a gateway for flue gas produced due to combustion downstream of a burner, wherein a suction created in the burner drives the flue gas into the burner through the plurality of flue gas ports, wherein the plurality of flue gas ports comprise angles that vary from 0 to 90 degrees a plurality of staged risers housed within the refractory block, wherein the plurality of staged risers is protected in staged fuel riser housings in the refractory block; and a discharge cone located in the refractory block for flame stabilization in the burner.

In another embodiment, a method of operating a refractory apparatus, can involve: providing a refractory block comprising a heat shield, wherein the refractory block includes a plurality of flue gas ports that acts as a gateway for flue gas produced due to combustion downstream of a burner, wherein a suction created in the burner drives the flue gas into the burner through the plurality of flue gas ports; protecting a plurality of staged risers housed within the refractory block with staged fuel riser housings in the refractory block; and stabilizing a flame with respect to the flue gas in a discharge cone located in the refractory block, wherein the discharge cone facilitates flame stabilization in the burner.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the detailed description of the invention, serve to explain the principles of the present invention.

Identical or similar parts or elements in the figures are indicated by the same reference numerals.

DETAILED DESCRIPTION

Figure 1:
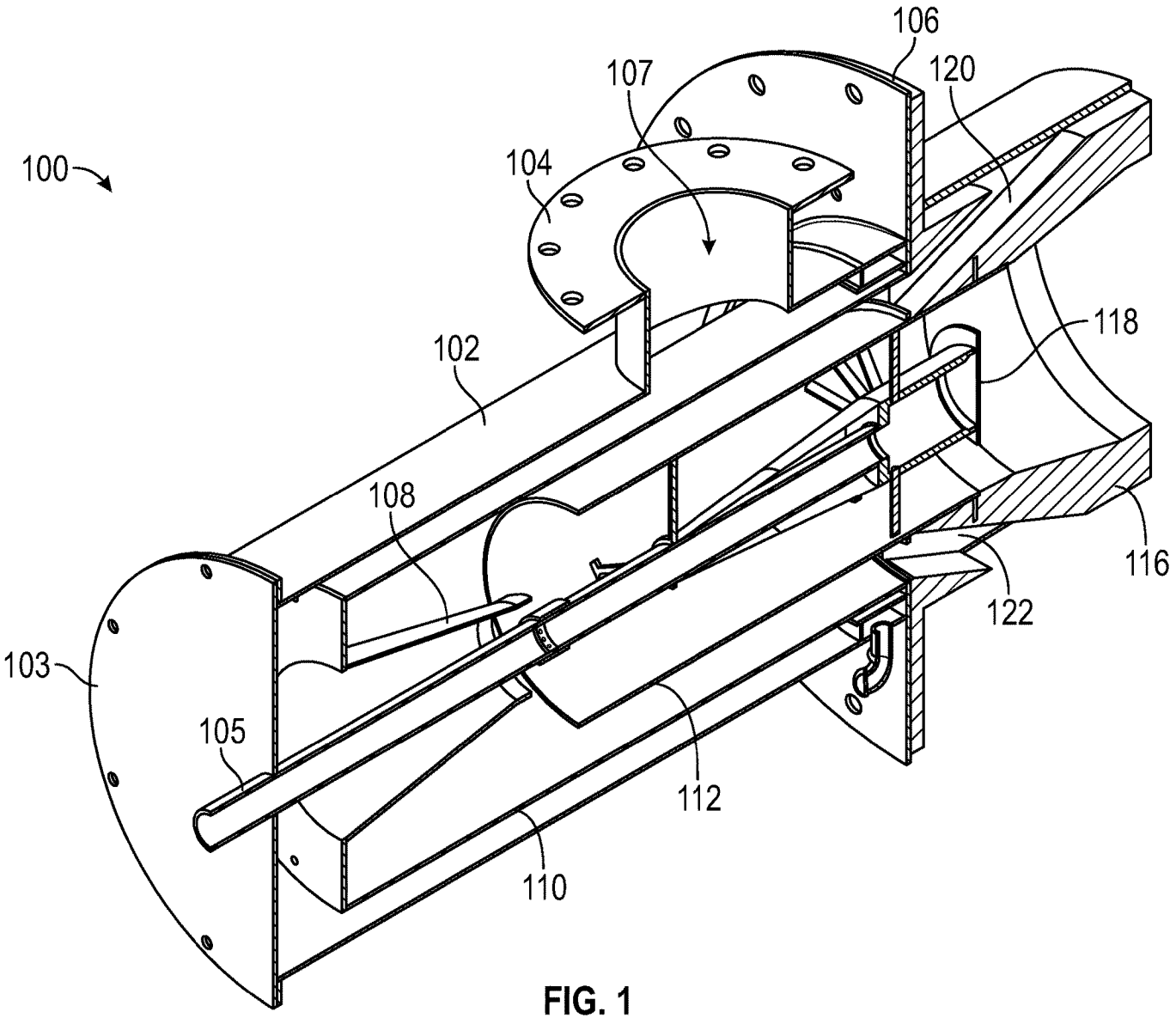
FIG. 1 illustrates a cut-away perspective view of a burner and associated burner components, in accordance with an embodiment.

The particular values and configurations discussed in these non-limiting examples can be varied and are cited merely to illustrate one or more embodiments and are not intended to limit the scope thereof.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other issues, subject matter may be embodied as methods, devices, components, or systems. Accordingly, embodiments may, for example, take the form of hardware, software, firmware, or a combination thereof. The following detailed description is, therefore, not intended to be interpreted in a limiting sense.

Throughout the specification and claims, terms may have nuanced meanings suggested or implied in context beyond an explicitly stated meaning. Likewise, phrases such as "in an embodiment" or "in one embodiment" or "in an example embodiment" and variations thereof as utilized herein may or may not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Generally, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. Furthermore, the term "at least one" as used herein, may refer to "one or more." For example, "at least one widget" may refer to "one or more widgets."

In addition, the term "based on" may be understood as not necessarily intended to convey an exclusive set of factors and may, instead, allow for existence of additional factors not necessarily expressly described, again, depending at least in part on context.

FIG. 1 illustrates a cut-away perspective view of a burner 100, in accordance with an embodiment. The burner 100 can be implemented as an ultra-low NOx (ULE) burner 100 that uses Internal Flue Gas Recirculation (IFGR). FIG. 1 depicts the burner major components of the burner 100 including, for example, a cylindrically shaped housing 102 maintains components such as a jet pump 108, an Flue Gas Recirculation (FGR) tube 110, and a mixing tube 112. A fuel inlet 105 can be partially surrounded by the jet pump 108 and the mixing tube 112.

The ultra-low NOx burner 100 can manage and optimize fuel and air mixing, which can occur inside, for example, the burner 100 and/or other devices such as a boiler. As the process is optimized, a large and much more balanced flame can be created, which can reduce the peak temperature and therefore a minimal amount of NOx may be produced.

The burner 100 can further include a combustion air inlet 107 surrounded by a circular flange 104 located to the left of a burner flange 106. The right portion of the burner 100 can include one or more FGR ports such as FGR port 120, FGR port 122, etc., along with a refractory block 116 and a torpedo assembly 118.

In the burner 100, flue gas can be pulled into the burner 100 with the jet pump 108, which can act like a suction pump. The flue gas can be pulled into the burner from flue gas ports that are incorporated into a refractory block 116 and a burner flange 106. The flue gas mixes with the air stream in a mixing zone. The flame can be stabilized at the end of the burner 100 in a discharge cone. In the burner 100, less than, for example, 25 ppm NOx may be achieved.

In order for this IFGR technology to function properly, the flue gas has to be pulled from a combustion chamber and then mixed with the incoming air stream. In the embodiments, the flue gas can be pulled from a burner head configured from the refractory block 116. This configuration can require a careful design of the refractory block 116, which can also act as a discharge cone and can house second stage risers.

Figure 2:
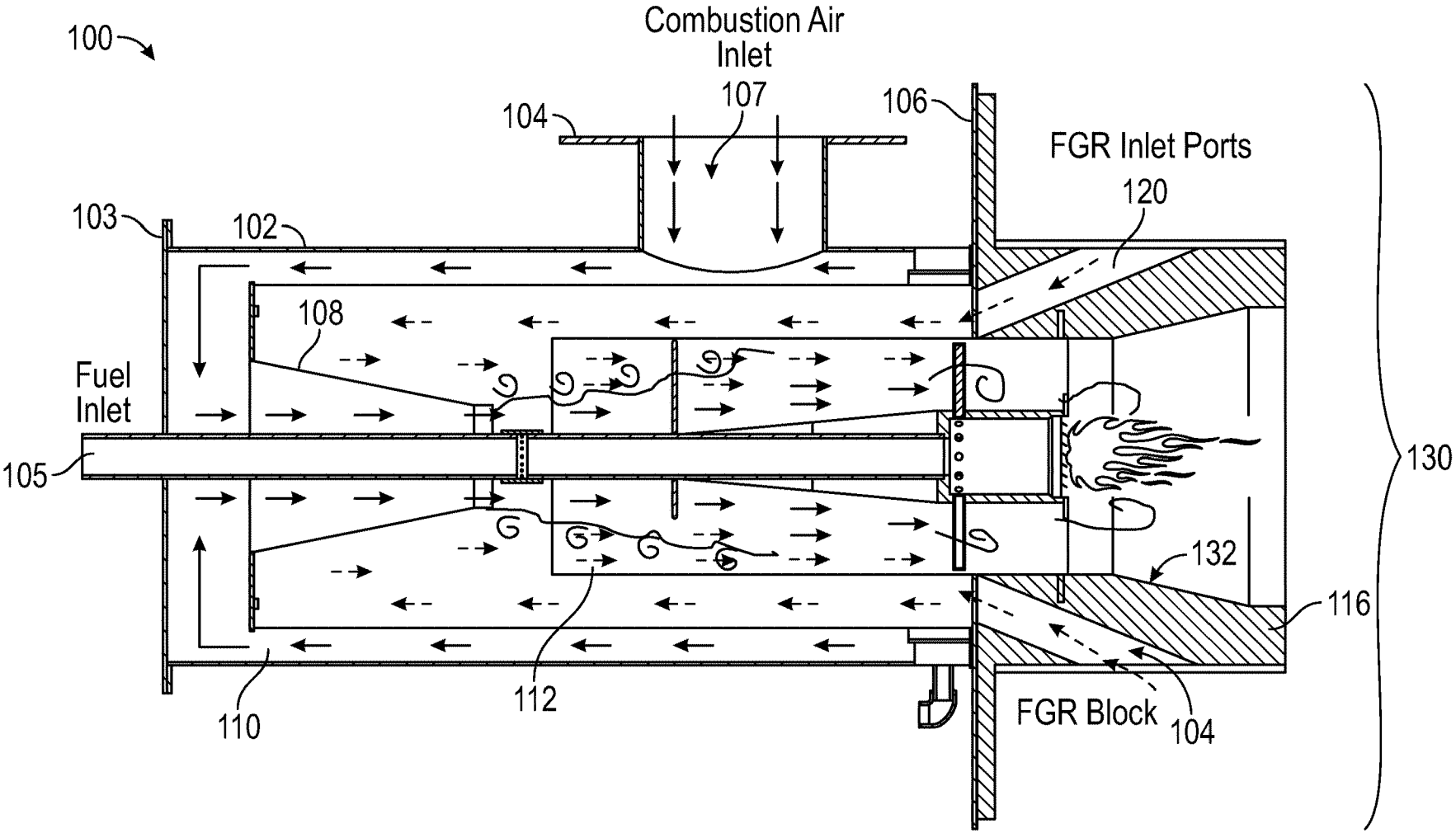
FIG. 2 illustrates a side sectional view of the burner shown in FIG. 1 including the Internal Flue Gas Recirculation (IFGR) path, in accordance with an embodiment.

FIG. 2 illustrates a side sectional view of the burner 100 shown in FIG. 1 including a Flue Gas Recirculation (FGR) path, in accordance with an embodiment. The FGR path is depicted in FIG. 2 by the path of the arrows depicted therein. FIG. 2 demonstrates the design of the burner 100 with the flow path of flue gas recirculation and the role of the refractory block 116. The refractory block is an important component of the burner 100. The refractory block can solve four issues including: 1) the refractory block has flue gas ports (e.g., FGR ports 120, 122, etc.), which can be used to recirculate the flue gas into the burner 100; 2) the refractory block can serve to house the fuel staging risers; 3) the refractory block can act as a heat shield for the burner flange 106; and 4) the refractory block can act as a discharge cone 132 for the burner 100. As shown in FIG. 2, a refractory apparatus 130 can generally include or encompass the refractory block 116, the FGR block 104, and the FGR inlet ports 120, 122, etc.

Figure 3:
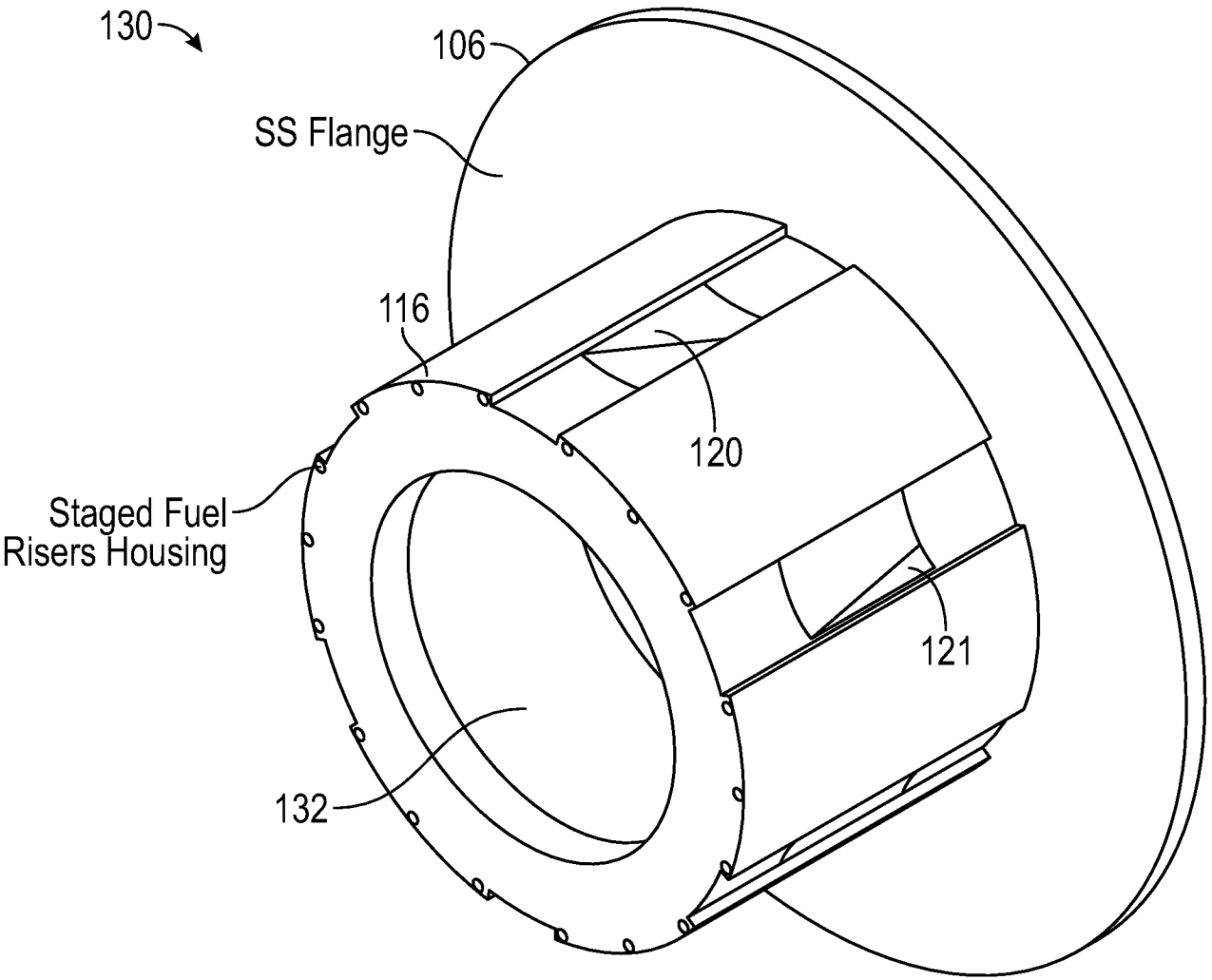
FIG. 3 illustrates a perspective view of a refractory apparatus for use with the burner shown in FIG. 1 and FIG. 2, in accordance with an embodiment.

FIG. 3 illustrates a perspective view of the refractory apparatus 130 including the refractory block 116 of the burner 100 shown in FIG. 1 and FIG. 2, in accordance with an embodiment. The refractory apparatus 130 can function as a heat shield. The refractory block 116 can include a group of flue gas ports that can function as a gateway for flue gas produced due to combustion downstream of the burner 100. A suction created in the burner 100 can drive the flue gas into the burner 100 through the flue gas ports. A group of staged risers can be housed within the refractory block 116. The staged risers are protected in staged fuel riser housings in the refractory block 116. The discharge cone 132 can be located in the refractory block 116 for flame stabilization in the burner 100.

The refractory block 116 can be configured with refractory material composed on aluminum and silicon oxides with a temperature rating of greater than, for example, 2600 F. The refractory block 116 can be configured with several flue gas ports ranging to 4-12. The slots can be either circular or rectangular with curved edges. The slot angle can vary between 0 to 90 degrees. The slot area may be selected to attain flue gas up to, for example, 20% of the combustion air. The flue gas ports are the gateway for the flue gas that can be produced due to the combustion downstream of the burner 100. The suction created in the burner 100 can drive the flue gas into the burner 100 through the flue gas ports. The refractory block 116 also houses the staged rises. The staged risers can be configured from stainless steel. The risers are protected in the staged fuel riser housings in the refractory block 116.

Figure 4:
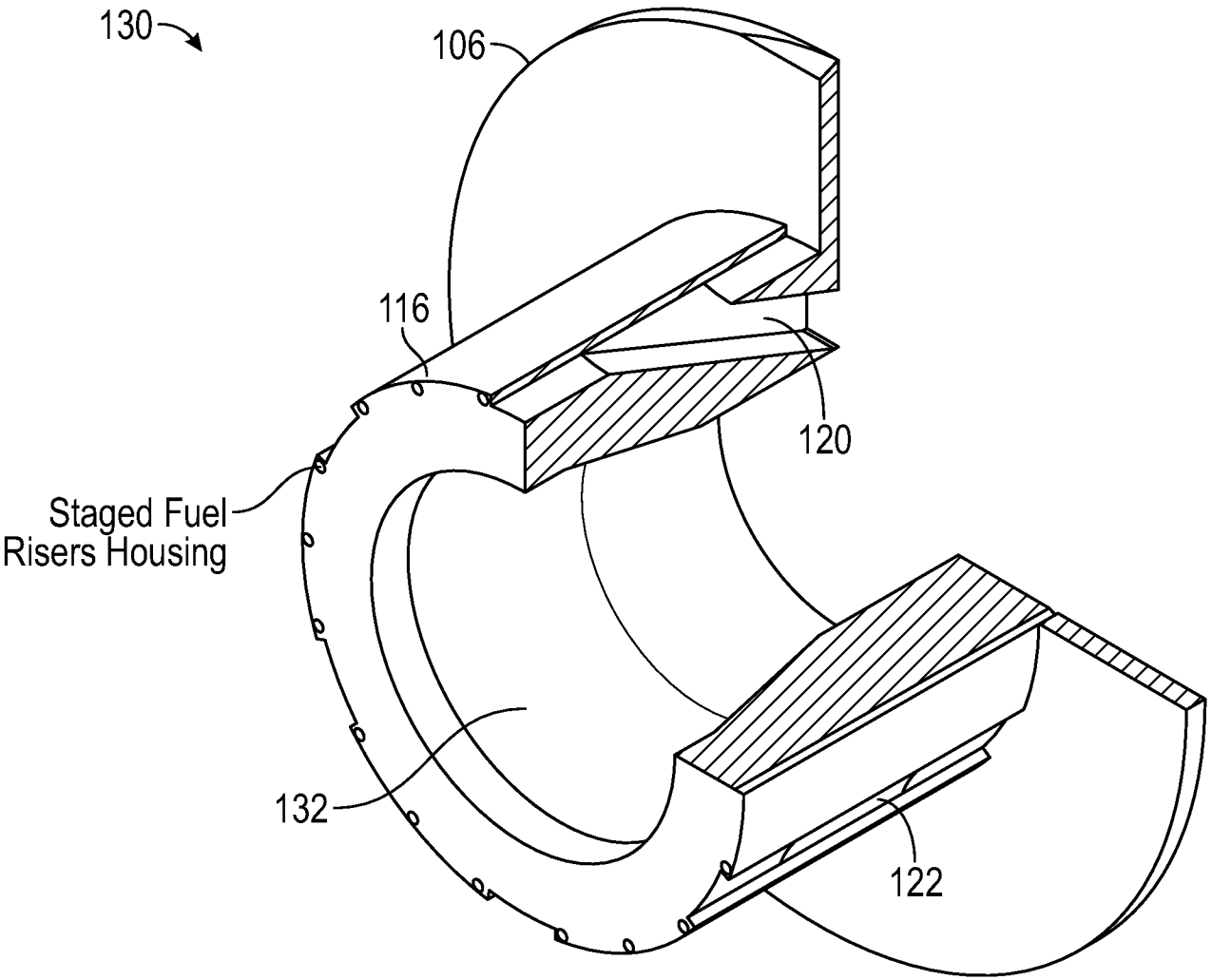
FIG. 4 illustrates a cut-sectional view of the refractory apparatus shown in FIG. 3, in accordance with an embodiment.

FIG. 4 illustrates a cut-sectional view of the refractory apparatus 130 shown in FIG. 3, in accordance with an embodiment. The refractory block 116 can also incorporate the discharge cone 132 for flame stabilization. The embodiments can reduce the $NO_x$ up to 50% than without the FGR ports and riser housing.

The burner 100 can be implemented, for example, in the context of fired process heaters and boilers. The burner 100 offers a novel "torpedo" design with the refractory 100 and/or the refractory block 116 as a key component of the ULE burner 100. This is a novel design where a single component of the ULE burner 100 can solve the aforementioned issues of a) internal flue gas recirculation; b) flame stabilization; c) staged risers; and d) heat shield. The ULE burner 100 can reduce $NO_x$ up to 50% from indirect fired burners and with a turn-down ratio of 10:1. This method of internal flue gas recirculation is unique and consolidates a ULE burner design for low NOx of less than 25 ppm. There are presently no burners that can effectively produce very low NOx in indirect fired process heaters and boilers with IFGR. The disclosed embodiments can eliminate external flue gas recirculation piping and high temperature blowers and can also be scaled to larger burner sizes.

The refractory block 116 can be cast on a stainless-steel flange with a sleeve. The studs can be welded to the stainless steel flange and then refractory material can be poured into the mold made for each block size. The casting can be allowed to rest for 24-28 hours until the cast is set. The refractory block 116 can be prefixed at a low temperature for 4-6 hours, for example, to allow for sufficient time for the cast to harden and remove the moisture in the cast. The number of FGR slots and the riser housing ports may be selected based on the burner size and NOx requirements.

The refractory block 110 can be used in, for example, the ULE-Burner series of burner products from Honeywell International Inc., or may be implemented in other burner products, designs and burner systems. The burner sizes may range from, for example, 2.5 MMBTU/hr to 50 MMBTU/hr. Each burner will have a refractory block installed. This component of the burner 100 may be critical for the functioning of the burner 100. The burner 100 and related components can be installed in indirect fired systems such as process heaters and boilers.

Figure 5:
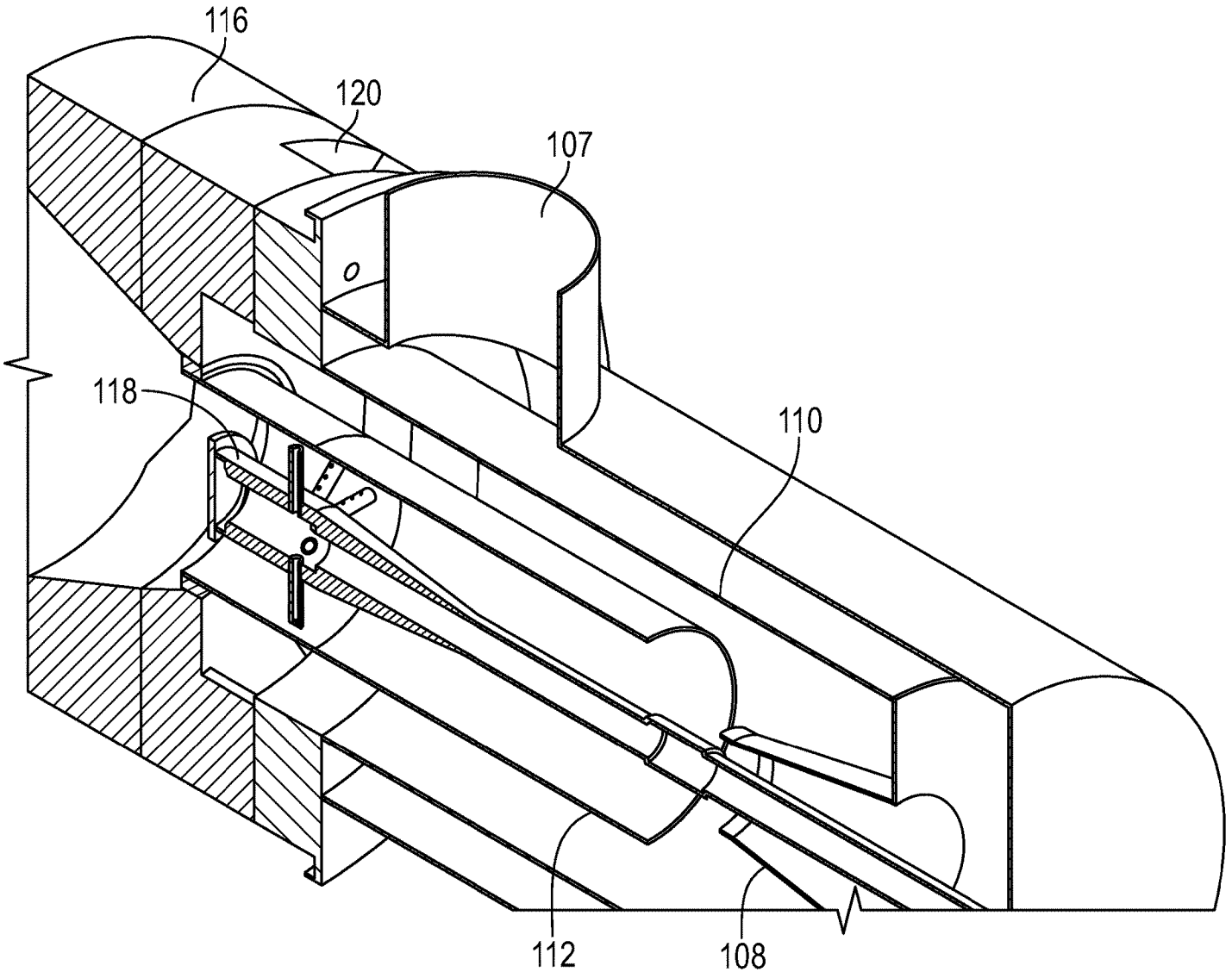
FIG. 5 illustrates a cut-away perspective view of a burner and associated burner components, in accordance with an alternative embodiment.

FIG. 5 illustrates a cut-away perspective view of a burner 101 and associated burner components, in accordance with an alternative embodiment. The burner 101 shown in FIG. 5 is similar to the previously described burner 100 albeit with a different design. The burner 101 includes similar components such as the refractory block 116, inlet ports such as inlet port 120, the combustion air inlet 107, the FGR tube 110, the jet pump 108, and the mixing tube 112. The torpedo assembly 118 is shown in FIG. 5 in the context of a different burner design.

Figure 6:
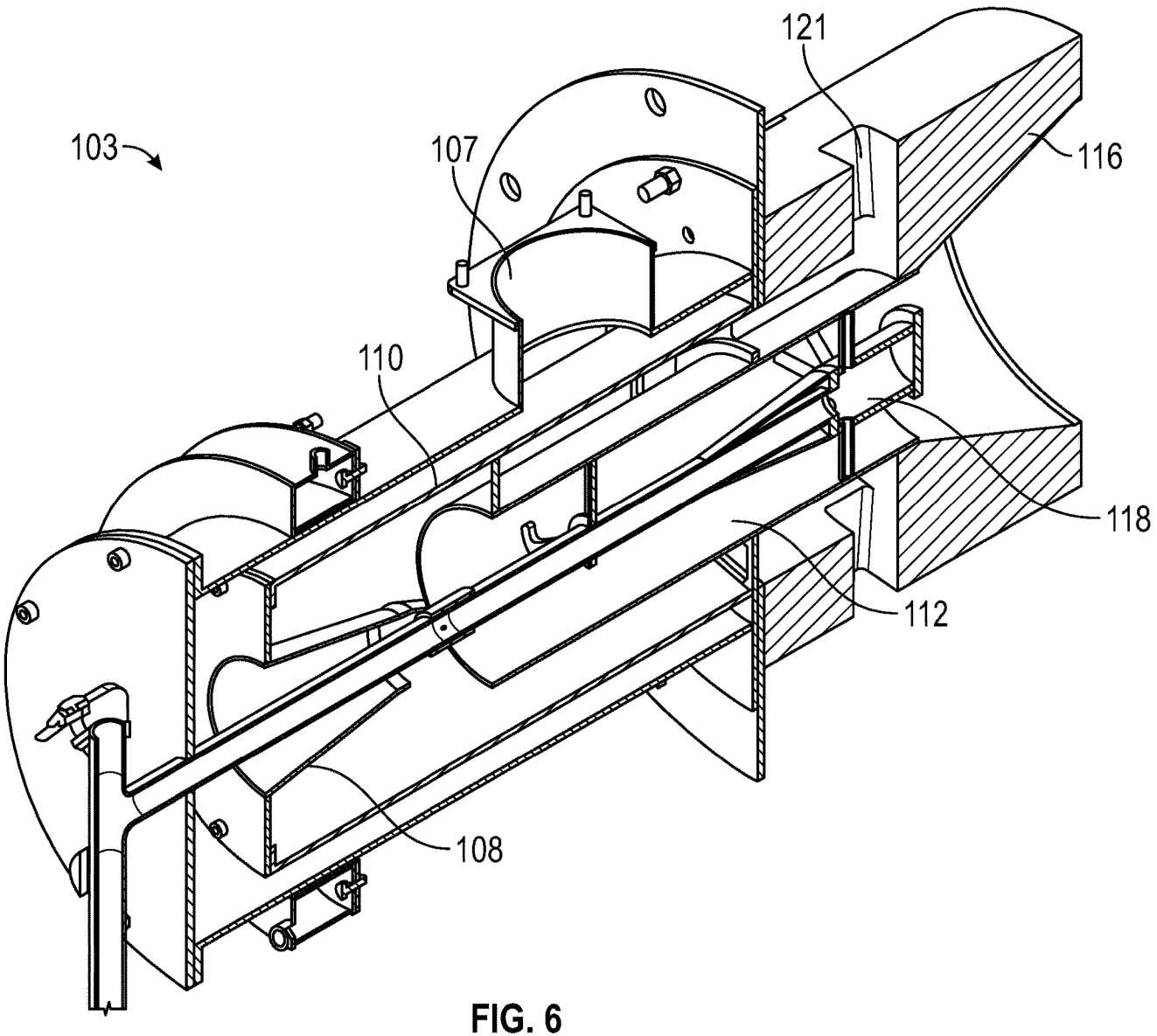
FIG. 6 illustrates a cut-away perspective view of a burner and associated burner components, in accordance with yet another embodiment.

FIG. 6 illustrates a cut-away perspective view of a burner 103 and associated burner components, in accordance with yet another embodiment. The burner 103 shown in FIG. 5 is similar to the previously described burner 100 and burner 101, albeit with a variation to the design of the FGR inlet ports. That is, the burner 103 can include many of the same components as the other burners 100, 101, but with a different design configuration. In the configuration shown in FIG. 6, the FGR inlet ports are shown as 90° inlet port(s) 121. That is, the design of burner 103 incorporates variation of the refractory block 116 where the angle is 90 degrees.

Based on the foregoing, it can be appreciated that a number of embodiments are disclosed herein. For example, in an embodiment, a refractory apparatus 130 may include the refractory block 116 which can function as or comprise a heat shield. The refractory block 116 can include a group of flue gas ports that can act as a gateway for the flue gas produced due to combustion downstream of the burner 100, 101. A suction created in the burner 100, 101 can drive the flue gas into the burner 100, 101 through the group of flue gas ports. Furthermore, staged risers can be housed within the refractory block 116. The staged risers can be protected in staged fuel riser housings in the refractory block 116. The discharge cone 132 can be located in the refractory block 116 for flame stabilization in the burner.

In an embodiment of the refractory apparatus 130, the plurality of flue gas ports can comprise angles that vary from 0 to 90 degrees.

In an embodiment of the refractory apparatus 130, the refractory block can comprise a refractory material configured on aluminum and silicon oxides with a temperature rating greater than, for example, 2600 F.

In an embodiment of the refractory apparatus 130, each flue gas port among the plurality of flue gas ports can include or be configured with a slot having a slot area selected to obtain flue gas up to, for example, 20% of combustion air.

In an embodiment of the refractory apparatus 130, a slot can be configured with a shape that is circular or rectangular with curved edges.

In an embodiment of the refractory apparatus 130, a flange can be connected to the refractory block.

In an embodiment of the refractory apparatus 130, each staged riser among the plurality of staged rises can comprise stainless steel.

In an embodiment of the refractory apparatus 130, the plurality of flue gas ports can include a number of flue gas ports ranging from four flue gas ports to twelve flue gas ports.

In another embodiment, the refractory apparatus 130 can include a refractory bock comprising a heat shield, wherein the refractory block includes a plurality of flue gas ports that acts as a gateway for flue gas produced due to combustion downstream of a burner, wherein a suction created in the burner drives the flue gas into the burner through the plurality of flue gas ports, wherein the plurality of flue gas ports comprise angles that vary from 0 to 90 degrees a plurality of staged risers housed within the refractory block, wherein the plurality of staged risers is protected in staged fuel riser housings in the refractory block; and a discharge cone located in the refractory block for flame stabilization in the burner.

In yet another embodiment, a method of operating a refractory apparatus 130, can involve: providing a refractory block comprising a heat shield, wherein the refractory block includes a plurality of flue gas ports that acts as a gateway for flue gas produced due to combustion downstream of a burner, wherein a suction created in the burner drives the flue gas into the burner through the plurality of flue gas ports; protecting a plurality of staged risers housed within the refractory block with staged fuel riser housings in the refractory block; and stabilizing a flame with respect to the flue gas in a discharge cone located in the refractory block, wherein the discharge cone facilitates flame stabilization in the burner.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A burner, comprising:

a housing having at least a first end, a second end, a combustion air inlet, and a housing inner surface that defines a housing chamber;

a burner flange extending radially from the second end of the housing;

a jet pump mounted within the housing chamber, the jet pump having a jet pump inlet and a jet pump outlet, the jet pump inlet in fluid communication with the combustion air inlet to receive a flow of combustion air therefrom;

a flue gas recirculation tube mounted within the housing chamber and having at least an inner surface that defines a recirculation tube chamber for receiving a flow of flue gas;

a mixing tube mounted within the housing chamber downstream of the jet pump outlet and having a mixing tube chamber that receives the flow of combustion air from the jet pump outlet and the flow of flue gas from the recirculation tube chamber;

a fuel inlet tube mounted at least partially within the housing chamber and extending through the jet pump and into the mixing tube;

a single refractory block disposed downstream of the second end of the housing and coupled to the burner flange, the single refractory block having:

a plurality of flue gas recirculation ports formed therein, each flue gas recirculation port in fluid communication with the recirculation tube chamber for supplying the flow of flue gas thereto;

an inner surface that defines a discharge cone downstream of the mixing tube; and a plurality of staged riser housings disposed therein, each staged riser housing having a stager riser housed therein, wherein:

the flow of combustion air into the jet pump generates a suction that draws flue gas into and through the flue gas recirculation ports, into and through the flue gas recirculation tube, and into the mixing tube chamber, the combustion air and the flue gas in the mixing tube mix together to provide a combustible gas, and each flue gas recirculation port is sized such that the flue gas is up to 20% of the combustible gas.

2. The burner of claim 1 wherein each of the plurality of flue gas ports comprises an angle that vary from 0 to 90 degrees.

3. The burner of claim 1 wherein the single refractory block comprises a refractory material configured on aluminum and silicon oxides with a temperature rating greater than 2600 F.

4. The burner of claim 1 wherein at least a portion of each flue gas port comprises a shape that is at least one of: circular or rectangular with curved edges.

5. The burner of claim 1 wherein each staged riser among the plurality of staged rises comprises stainless steel.

6. The burner of claim 1 wherein the plurality of flue gas ports comprises a number of flue gas ports ranging from four flue gas ports to twelve flue gas ports.

* * * * *